US010927499B2

(12) United States Patent
Lindblom

(10) Patent No.: US 10,927,499 B2
(45) Date of Patent: Feb. 23, 2021

(54) REFINER SEGMENT IN A FIBER REFINER

(71) Applicant: VALMET AB, Sundsvall (SE)

(72) Inventor: Thommy Lindblom, Hägersten (SE)

(73) Assignee: VALMET AB, Sundsvall (SE)

( * ) Notice: Subject to any disclaimer, the term of this patent is extended or adjusted under 35 U.S.C. 154(b) by 197 days.

(21) Appl. No.: 16/186,803

(22) Filed: Nov. 12, 2018

(65) Prior Publication Data

US 2019/0145048 A1 May 16, 2019

(30) Foreign Application Priority Data

Nov. 14, 2017 (SE) ..... 1751406-8

(51) Int. Cl.
*D21D 1/30* (2006.01)

(52) U.S. Cl.
CPC ..... *D21D 1/306* (2013.01)

(58) Field of Classification Search
USPC ..... 162/261
See application file for complete search history.

(56) References Cited

U.S. PATENT DOCUMENTS 3,910,511 A 10/1975 Leider et al.
5,373,995 A * 12/1994 Johannson ..... B02C 7/12 241/17
6,032,888 A 3/2000 Deuchars
6,311,907 B1 11/2001 Gingras
2004/0149844 A1 8/2004 Antensteiner
2012/0012685 A1 1/2012 Gingras
2017/0275819 A1 9/2017 Gingras

FOREIGN PATENT DOCUMENTS

WO WO 2012/115526 A1 8/2012

OTHER PUBLICATIONS

Extended European Search Report, dated Apr. 10, 2019, 8 pages.

* cited by examiner

*Primary Examiner* — Mark Halpern
(74) *Attorney, Agent, or Firm* — Foley & Lardner LLP

(57) ABSTRACT

A refiner segment for a refiner comprising refining zones provided with a pattern of bars arranged at a respective pumping feeding angle within a respective refining zone, and intermediate grooves between the bars, and dams extending between the bars and protruding above the surface of the grooves. The dams are arranged at least at the ends of at least some of the bars at the borders between the refining zones. Openings are formed at the borders between the refining zones, radially outside of the dams, where the openings are arranged such that a respective angle is formed between an imaginary line connecting the openings and a line which is perpendicular to a radius of the refiner segment, where the angle is directed towards the inner edge of the refiner segment, thereby allowing steam to pass through the openings and flow towards an inner edge of the refiner segment.

12 Claims, 4 Drawing Sheets

REFINER SEGMENT IN A FIBER REFINER

TECHNICAL FIELD

The present invention generally relates to refining of fibrous material in a fiber refiner, and more particularly to feed variations during the refining process.

BACKGROUND

Refiners used for refining fibrous material, such as wood chips, into pulp typically comprise one or more refiner elements positioned oppositely and rotating relative to each other. One or both of the refiner elements can be rotatable. A fixed i.e. stationary refiner element is called the stator and the rotating or rotatable refiner element is called the rotor. In disc refiners, the refiner elements are disc-like and in cone refiners the refiner elements are conical. In addition to disc refiners and cone refiners, there are also so-called disc-cone refiners where the material to be defibrated is first refined by disc-like refiner elements and then further refined between conical refiner elements. Furthermore, there are also cylindrical refiners where both the stator and the rotor of the refiner are cylindrical refiner elements.

The refiner elements are positioned such that a refining space/gap is formed between the inner surfaces, i.e. the surfaces opposing one another, of the refiner segments. In disc refiners, which represent the most common refiner type, the material to be refined is usually fed through an opening in the middle of one of the refiner discs, usually the stator, to a central space between the discs. The material is then forced by the centrifugal force towards the circumference of the discs to emerge in the refining space/gap, where the refining/grinding of the fibrous material is carried out. The refined material is discharged from the refining space/gap, from the outer periphery of the refining surfaces of the refiner discs, to be fed onwards in the pulp manufacturing process.

The inner (refining) surfaces of the refiner elements are typically provided with one or more refiner segments, which are formed with a pattern of bars and intermediate grooves of different sizes and orientations, for improving the grinding action on the fibers. The refiner segments are typically positioned adjacently in such a way that each refiner segment forms part of a continuous refining surface. The pattern of bars and grooves may be divided into different zones located outside each other, e.g. a radially inner inlet zone where the fibrous material is fed into the refiner, and one or more radially outer refining zones where the refining of the material takes place. In the inlet zone there are usually fewer bars and grooves, and the pattern is coarser than in the refining zone(s).

Normally, the bars and grooves of the refiner segments extend substantially radially with respect to the rotational center of the refiner elements/discs. The bars may be inclined relative to a radial line passing through the refiner element to achieve a pumping effect, i.e. to enhance the travel of the material to be refined from the direction of the inner circumference towards the outer circumference of the segment, or an anti-pumping effect, i.e. to slow down the travel of the material to be refined towards the outer circumference of the segment. Thus, a pumping bar is a bar that produces, for the material to be refined, both a circular velocity component and a radial velocity component directed away from the center of the refining surface. The bar angle, or the feeding angle, between a pumping bar and the radius of the refiner element is thus directed opposite to the direction of rotation of the refiner element. The feeding effect/capability of a refiner segment may be controlled by the feeding angle. Large feeding angles increase the feeding effect, while smaller angles, and even negative angles, reduce the feeding effect. If the refiner segment comprises more than one refining zone, the feeding angle of the bars is usually the same within a refining zone, and decreases towards the periphery of the refiner segment for each refining zone.

When the fibrous material is refined in the refining space/gap between the refiner elements, some of the moisture in the material is turned into steam. The steam flow is usually very irregular, but some steam will flow towards the circumference of the refiner elements along with the material, and some of the steam will also flow "backwards" towards the center of the refiner elements. The steam flow will depend—among other things—on how the refiner segments are designed. The back-streaming steam will mainly flow in the grooves formed between the bars of the refiner segments towards the center of the refiner elements.

Usually, flow restrictions or dams are inserted in the grooves in the refiner segments in order to prevent unprocessed material to pass out through the refining gap. The dams guide the material to the space between opposite refiner bars, and thereby refining of the material can be promoted. However, the dams constitute an obstacle to the steam developed in the refining gap during the refining process. The steam is also forced upwards out of the grooves by the dams and disturbs the material flow through the refining gap. This in turn leads to blockage on the refining surface, which may affect the stability of the refining gap, rendering the material flow through the gap non-uniform. Variations in feed within the refining gap causes a decrease in the production capacity of the refiner, non-uniformity of the quality of the refined material and an increase in the energy consumed for the refining. Therefore, there is a need for improving the design of the refiner segments in order to overcome the above mentioned disadvantages.

SUMMARY

It is an object to provide a refiner disc which reduces the feed variations during the refining process.

This and other objects are met by embodiments of the proposed technology.

According to a first aspect, there is provided a refiner segment arrangeable on a refiner element in a refiner intended for refining fibrous material. The refiner segment has a radially inner edge and a radially outer edge and comprises refining zones where refining of the fibrous material takes place. The refiner segment is configured to travel in a first circumferential direction corresponding to an intended rotational direction of the refiner element when the refiner segment is arranged on the refiner element, and is provided with a pattern of bars arranged at a respective feeding angle within a respective refining zone, where the feeding angle is directed opposite to the first circumferential direction, and intermediate grooves between the bars, and dams extending between the bars and protruding above the surface of the grooves. The dams are arranged at least at the ends of at least some of the bars at the borders between the refining zones such that openings are formed at the borders between the refining zones, radially outside of the dams, with respect to the radially inner edge of the refiner segment. The openings are arranged such that a respective angle is formed between an imaginary line connecting the openings at a radially inner border of a respective refining zone and a line which is perpendicular to the radius of the refiner segment, where the angle is directed towards the inner edge of the refiner segment.

According to a second aspect, there is provided a refiner element for refining fibrous material, comprising at least one refiner segment according to the above.

According to a third aspect, there is provided a refiner for refining fibrous material, comprising at least one refiner segment according to the above.

By introducing refiner segments according to the present disclosure, at least the following advantages can be achieved:

- The angle of the bars and the width of the bars and grooves can be set individually for each refining zone, increasing the possibilities to improve the specific energy consumption, fiber quality and segment lifetime.
- Reduced feed conflicts in the refining gap which in turn leads to less disc gap instability, less uncontrollable turbulence, less vibrations, less micro-pulsation etc.
- Preventing the area just after the dams from becoming a "dead zone" with lower steam pressure and less movement of the material, which means that pitch build-up can be reduced or avoided.

Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference designations are used for similar or corresponding elements.

Figure 2:
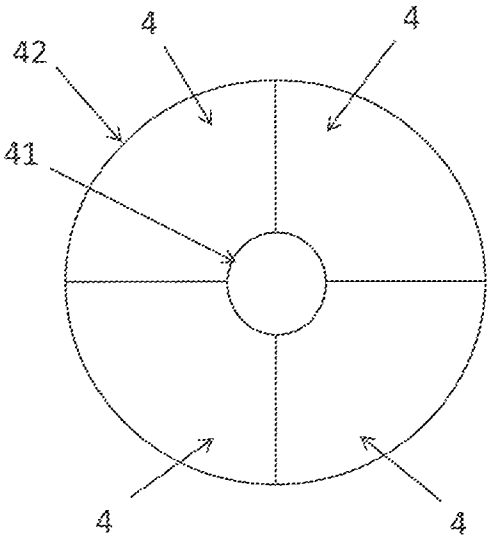
Fig. 2 (PRIOR ART)
FIG. 2 is a schematic illustration of a refining surface comprising a plurality of refiner segments according to prior art technology.
Figure 1:
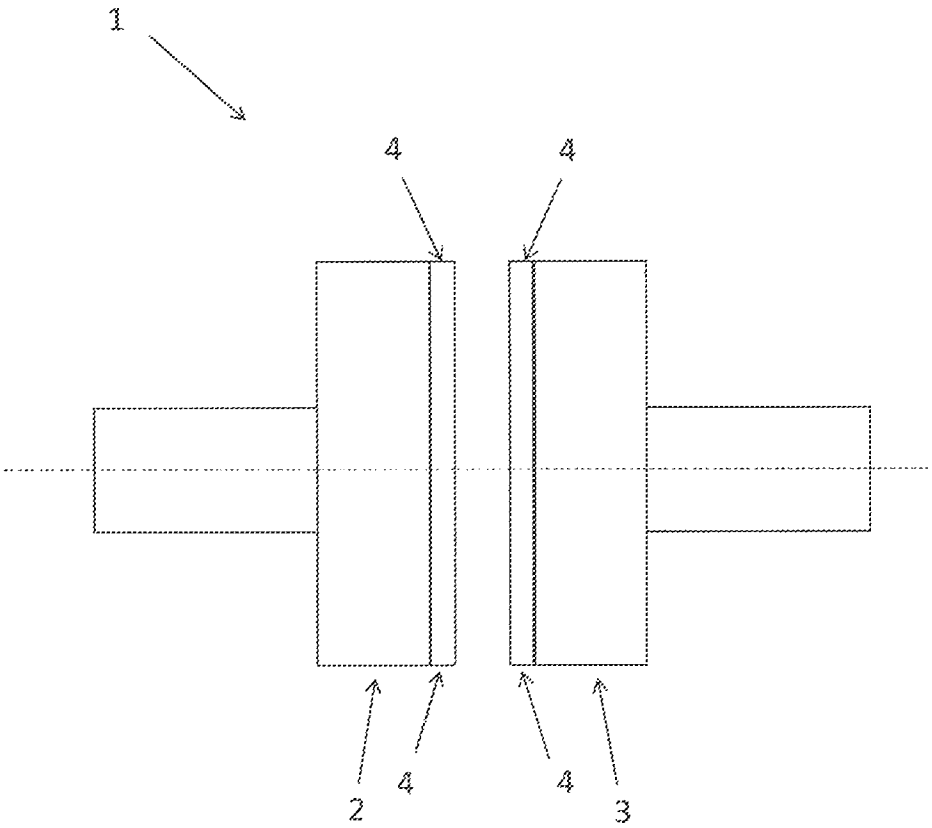
Fig. 1 (PRIOR ART)
FIG. 1 is a schematic illustration of a typical refiner comprising a coaxially arranged stator/rotor disc pair according to prior art technology.

For further illustration of the prior art, a typical refiner 1 comprising refiner elements in the form of a coaxially arranged stator/rotor disc pair 2, 3 according to prior art is schematically illustrated in FIG. 1. At least one of the refiner elements/discs 2, 3 is provided with a refining surface comprising a plurality of refiner segments 4, as illustrated in FIG. 2. Each refiner segment 4 has a radially inner edge 41 facing the center of the refiner element and a radially outer/peripheral edge 42 facing the periphery of the refiner element, when the refiner segment 4 is arranged on the refiner element 2; 3. The stator/rotor disc pair 2, 3 can comprise e.g. one stator 2 and one rotor 3, or two rotors. In case of the rotor/rotor arrangement the two rotors are configured with opposing rotational directions. In the current disclosure the main emphasis is on disc refiners, but the disclosure can be equally implemented in other refiner geometries as well.

Figure 3A:
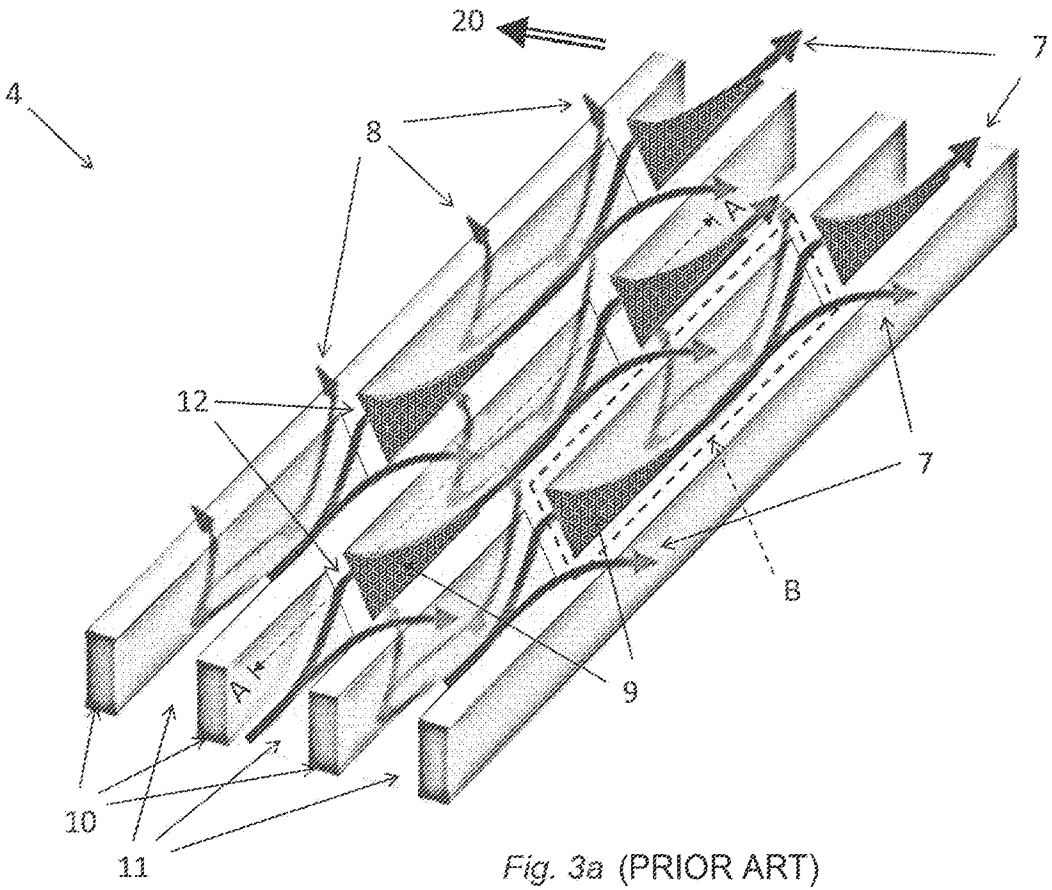
Fig. 3a (PRIOR ART)
FIG. 3*a* is a schematic illustration of a part of a refiner segment according to prior art technology.

As described in the background section there is continued need in the art to further reduce the feed variations during the refining process. FIG. 3*a* is a schematic illustration of a part of a refiner segment 4 arrangeable on a refiner element according to prior art, where the refiner segment 4 is provided with bars 10 and intermediate grooves 11 extending in a substantially radial direction, and dams 12 extending between the bars 10 and protruding above the surface of the grooves 11. The figure shows the steam flow 8 and the flow of fibrous material 7 on the refiner segment 4, when the refiner segment 4 is travelling in a first circumferential direction 20 corresponding to an intended travelling direction of the refiner segment 4, which corresponds to an intended rotational direction of the refiner element when the refiner segment 4 is arranged on the refiner element. FIG. 3*a* illustrates an example where the first circumferential direction 20 of the refiner segment 4 corresponds to a counter-clockwise rotational direction of the refiner element. The material 7 flows in a direction towards the periphery of the refiner segment 4. In conventional refiner segment designs the bars 10 and dams 12 typically form closed-off "boxes" or "cages", as illustrated by the dashed box B, which traps the steam 8 and forces it upwards out of the grooves and out into the refining gap.

At least the following problems are associated with this design:

- Steam 8 that is trying to go backwards (or forwards) is "caged in" and forced to find its way out into the refining gap. This causes feed conflicts between the steam 8 and the fibrous material 7 in the refining gap, which leads to feed disturbance, vibrations, micro-pulsation etc.
- The area just after the dams 12 becomes a "dead zone" with lower steam pressure and much less movement of the material 7, which causes pitch build-up 9 of the material in this zone. Once this pitch build-up starts, it will escalate.
- Difficult to alter the pulp feeding angle and open area over the segment surface (i.e. the radius). By open area is meant the cumulative area at a circumference at a radius of interest. Open area is important to achieve flow through the disk refiner.

Figure 3B:
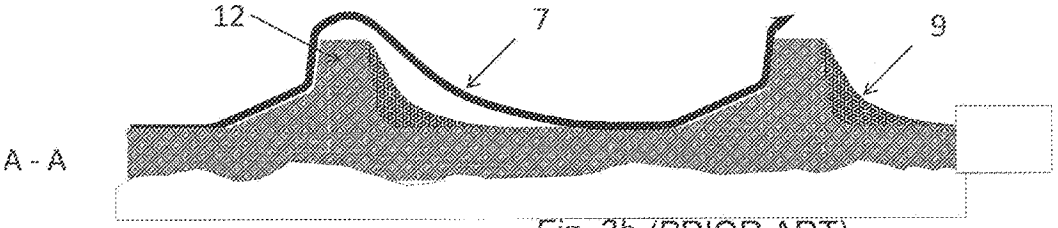
Fig. 3b (PRIOR ART)
FIG. 3*b* is a cross-section of the refiner segment of FIG. 3*a*.

FIG. 3*b* is a cross-section of the refiner segment 4 along the line A-A of FIG. 3*a*, illustrating the pitch build-up 9 of the material 7 in the area behind the dam 12, from a different view.

The present embodiments solve the above-mentioned problems by connecting the bars within a refining zone of the refiner segment with the dams in such a way that openings are formed in an anti-pumping direction, allowing steam to flow backwards without allowing the material to escape forwards without treatment. Furthermore, the present embodiments allow the angle of the bars and the width of the bars and grooves to be set individually for each refining zone, increasing the possibilities to improve the specific energy consumption, fiber quality and segment lifetime.

Figure 4:
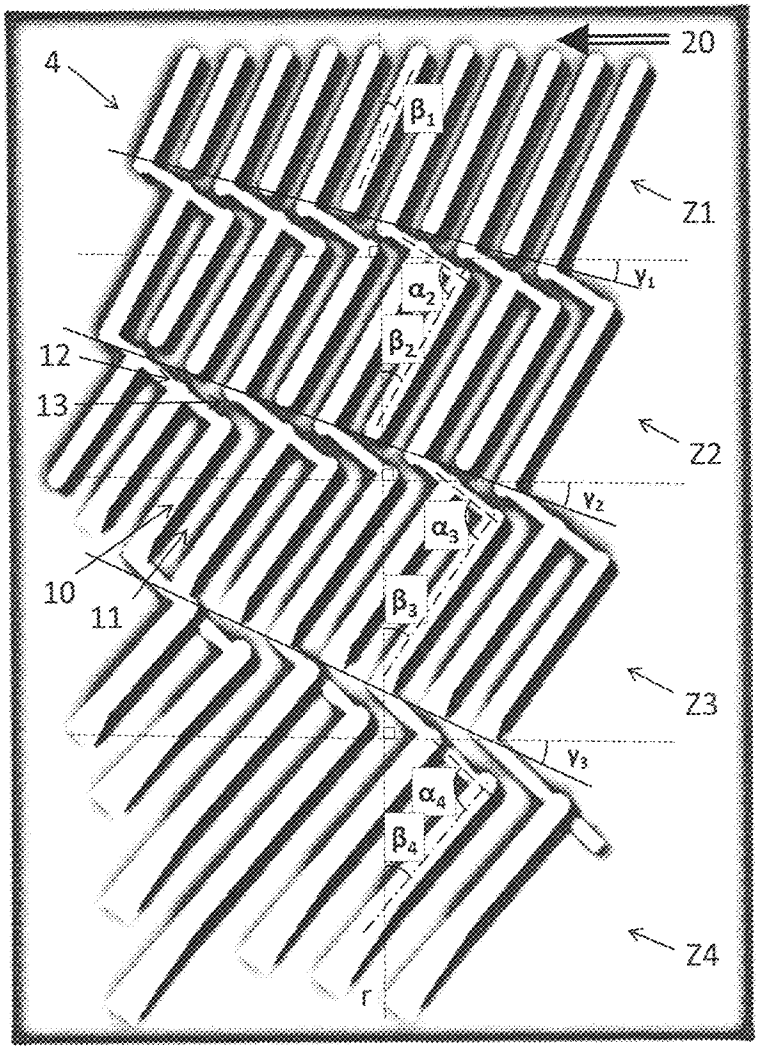
FIG. 4 is a schematic illustration of a part of a refiner segment according to an embodiment of the present disclosure.

FIG. 4 is a schematic illustration of a part of a refiner segment 4 arrangeable on a refiner element according to an embodiment of the present disclosure. The refiner segment 4 may comprise one or more refining zones Z(x), x=1, . . . , n, where Zn represents the refining zone closest to the inner edge of the refiner segment, as illustrated by the refining zones Z1, Z2, Z3, Z4 in FIG. 4. The refiner segment 4 illustrated in FIG. 4 is provided with bars 10 arranged at a respective feeding angle $\beta_{(x)}$ relative to a radius r of the refiner segment 4 within a respective refining zone Z(x), and intermediate grooves 11 between the bars 10, and dams 12 extending between the bars 10 and protruding above the surface of the grooves 11. In the embodiment of FIG. 4 the dams 12 are arranged at least at the ends of at least some of the bars 10 at the transitions/borders between different refining zones Z(x), such that openings 13 are formed at the transitions/borders between the refining zones, radially outside of the dams, with respect to the inner edge 41 of the refining segment 4, thereby allowing the back-streaming steam to flow along the bars and dams and through the openings towards the inner edge of the refiner segment 4. The refiner segment 4 of FIG. 4 is configured to travel in a first circumferential direction 20, which corresponds to an intended rotational direction of the refiner element when the refiner segment 4 is arranged on the refiner element. FIG. 4 illustrates an example where the first circumferential direction 20 of the refiner segment 4 corresponds to a counter-clockwise rotational direction of the refiner element.

Figure 5B:
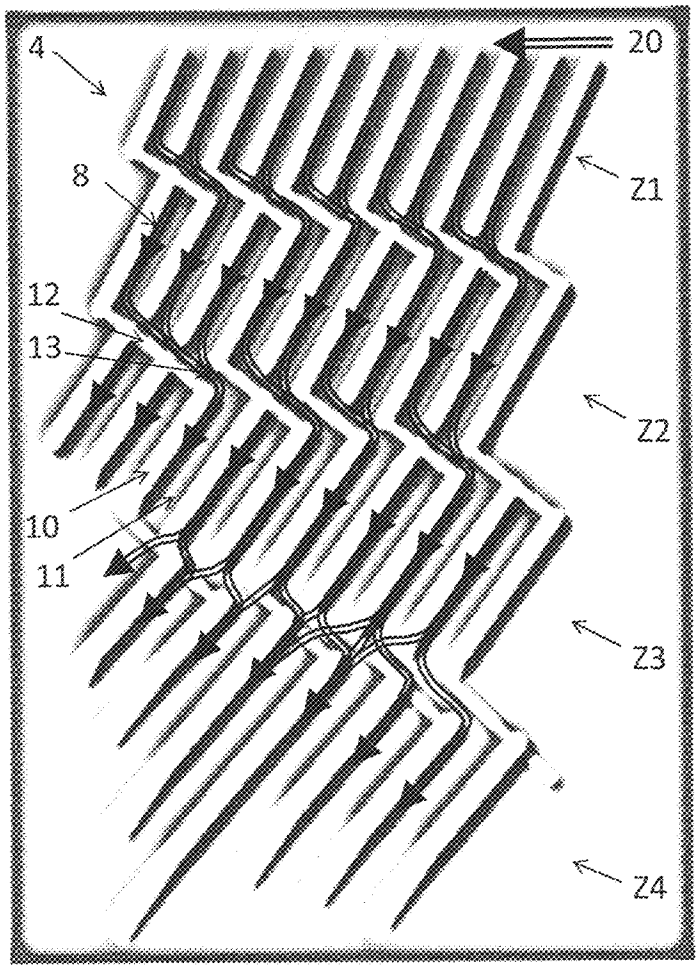
FIG. 5*b* is a schematic illustration of steam flow in a part of a refiner segment according to an embodiment of the present disclosure.
Figure 5A:
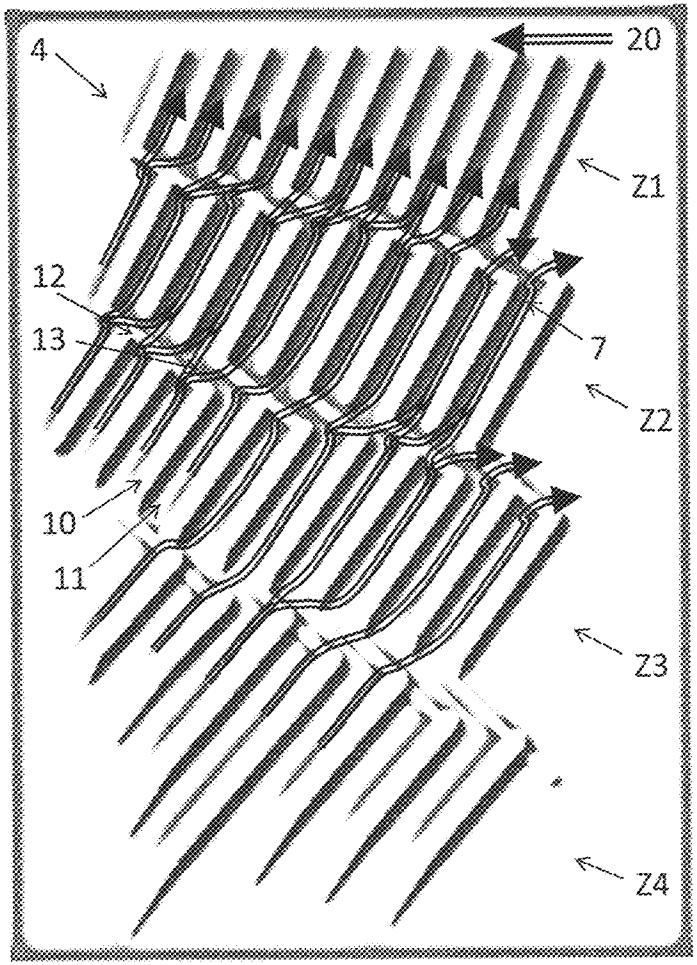
FIG. 5*a* is a schematic illustration of material flow in a part of a refiner segment according to an embodiment of the present disclosure.

FIG. 5*a* is a schematic illustration of the flow of fibrous material 7 and FIG. 5*b* a schematic illustration of the steam flow 8 on a refiner segment 4 arrangeable on a refiner element according to an embodiment of the present disclosure, when the refiner segment 4 is travelling in a first circumferential direction 20 which in this case corresponds to a counter-clockwise rotational direction of the refiner element. The material 7 flows in a direction towards the periphery/outer edge of the refiner segment 4, whereas the back-streaming steam 8 flows towards the inner edge of the refiner segment 4. The steam follows the bars 10, flows along the dams 12 and passes through the openings 13, and travels on like this towards the inner edge of the refiner segment.

In the embodiments illustrated in FIGS. 4, 5*a* and 5*b*, the openings 13 are formed at the transitions/borders between different refining zones Z(x), peripherally of the dams 12 with respect to the inner edge of the refiner segment 4, i.e. radially outside of the dams 12. Furthermore, the dams 12 in these embodiments are inclined such that the trailing end, with respect to the first circumferential direction 20, of a dam 12 is arranged closer to the inner edge of the refiner segment 4 than the leading end of the dam 12, so that the dams 12 are "pointing" obliquely inwards on the refiner segment 4, in order to guide the back-streaming steam 8 along the peripheral edges/walls of the dams 12 towards the openings 13.

As illustrated in FIG. 4, the bars 10 are arranged at a respective feeding angle $\beta_{(x)}$ relative to the radius r of the refiner segment 4 within a respective refining zone Z(x), and the dams 12 connecting the ends of the bars at the transitions/borders between the refining zones Z(x) are arranged at a respective angle $\alpha_{(x)}$ relative to the bars 10 within a respective refining zone Z(x). The lengths of the bars 10 within a refining zone Z(x) increases in a direction opposite to the first circumferential direction 20 in an embodiment, and are adapted such that an imaginary line can be drawn between the radially inner ends of the bars 10, i.e. between the openings 13 at a radially inner border of a respective refining zone Z(x), where the imaginary line is forming a respective angle $\gamma_{(x)}$ with a line which is perpendicular to the radius r of the refiner segment 4 within a respective refining zone Z(x). In an embodiment the feeding angle $\beta_{(x)}$ in each refining zone Z(x) is a pumping feeding angle, i.e. in order to achieve a pumping effect on the material to be refined, the feeding angle $\beta_{(x)}$ is directed opposite to the first circumferential direction 20. In order to guide the steam 8 towards the inner edge of the refiner segment 4, the angle $\alpha_{(x)}$ between the bars 10 and the dams 12 in each refining zone Z(x) is larger than 90° in an embodiment, and the angle $\gamma_{(x)}$ in each refining zone Z(x) is directed towards the inner edge of the refiner segment 4 in an embodiment.

In embodiments where the refiner segment 4 comprises more than one refining zone Z(x), e.g. Z1, Z2, Z3, . . . , Zn, where Zn represents the refining zone closest to the inner edge of the refiner segment 4, the angles $\beta_{(x)}$ and $\gamma_{(x)}$ increase towards the inner edge of the refiner segment 4 for each refining zone Z(x), i.e. $\beta_1 \leq \beta_2 \leq \beta_3 \leq \beta_n$ and $\gamma_1 \leq \gamma_2 \leq \gamma_3 \leq \gamma_n$.

According to a particular embodiment, $90° \leq \alpha_{(x)} \leq 110°$.

According to another particular embodiment, where the refiner segment 4 comprises more than one refining zone Z(x) as described above, $5° \leq \beta_1 \leq \beta_2 \leq \beta_3 \leq \beta_n \leq 45°$.

According to another particular embodiment, where the refiner segment 4 comprises more than one refining zone Z(x) as described above, $5° \leq \gamma_1 \leq \gamma_2 \leq \gamma_3 \leq \gamma_n \leq 45°$.

In an example embodiment, the radially inner end of every other bar 10 is connected to a dam 12.

In a particular embodiment, at least some of the dams 12 have a smaller height than the bars 10.

As illustrated in FIGS. 4, 5*a* and 5*b*, the openings 13 may in some embodiments be provided over the entire surface of the refining zones Z(x) of the refiner segment 4, thereby creating/forming a free passage through all of the refining zones Z(x) for the steam 8 flowing through the openings 13 and grooves 11 towards the inner edge of the refiner segment 4 and the center of the refiner element/disc. This will allow steam 8 to be evacuated from the refining zones Z(x) with minimum conflict with the flow of wood/fibrous material 7. In a particular embodiment, openings 13 are provided adjacent to all the dams 12 on the refiner segment 4.

At least the following advantages are achieved with this design:

- The angle of the bars and the width of the bars and grooves can be set individually for each refining zone, which means that the feeding capability and open volume can be altered by radius, leading to increased possibilities to optimize residual time to improve the specific energy consumption, fiber quality and segment lifetime.
- The steam travelling backwards can move freely without being forced into the refining gap, which leads to less refining gap instability and less uncontrollable turbulence.
- The steam never comes into conflict with the wood/fibrous material moving in the opposite direction, which leads to less or no feed conflicts and less pitch build-ups.

This is achieved without compromise in defibration/refining capability, i.e. wood/fiber flow restriction can still be the same.

All embodiments of the present disclosure can be fitted to a refiner arrangement well known in the art, for example refiners with a rotor-stator arrangement as well as refiners with two rotors instead of a rotor-stator arrangement, i.e. two rotors that can be rotated independently. In the current disclosure the main emphasis is on disc refiners, but the disclosure can be equally implemented in other refiner geometries as well.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A refiner segment arrangeable on a refiner element in a refiner intended for refining fibrous material, the refiner segment comprising:

a radially inner edge;

a radially outer edge;

a plurality of refining zones configured to refine the fibrous material and having at least one border positioned between adjacent refining zones;

a plurality of bars comprising respective bars arranged at a respective feeding angle within a respective refining zone, the feeding angle changing between refining zones such that a refining zone at the radially inner edge has a larger feeding angle than a refining zone at the radially outer edge;

a plurality of intermediate grooves between the plurality of bars;

a plurality of dams extending between at least some of the respective bars and protruding above a surface of the plurality of intermediate grooves; and a plurality of openings comprising respective openings within a respective refining zone;

wherein the refiner segment is configured to travel in a first circumferential direction corresponding to an intended rotational direction of the refiner element when the refiner segment is arranged on the refiner element, wherein the respective feeding angle is formed between a line extending along the respective bars in a direction opposite the first circumferential direction and a line extending along a radius of the refiner segment through the respective bars, wherein the plurality of dams are arranged at radially outer ends of at least some of the plurality of bars at the at least one border positioned between adjacent refining zones such that the plurality of openings are formed at the at least one border and positioned radially outside of the plurality of dams with respect to the radially inner edge of the refiner segment, wherein the respective openings are arranged such that a respective angle is formed between an imaginary line connecting the respective openings at a radially inner border of the respective refining zone, and a line which is perpendicular to the radius of the refiner segment, where the respective angle is directed towards the inner edge of the refiner segment.

2. The refiner segment according to claim 1, wherein the plurality of dams are inclined such that a trailing end, with respect to the first circumferential direction of the refiner segment, of a dam is arranged closer to the inner edge of the refiner segment than a leading end of the dam.

3. The refiner segment according to claim 1, wherein the dams are arranged within a respective refining zone at a second respective angle larger than 90° relative to the bars.

4. The refiner segment according to claim 3, wherein the second respective angle between the dams and the bars is between 90° and 110°.

5. The refiner segment according to claim 1, wherein the respective feeding angle and the respective angle increase towards the inner edge of the refiner segment for each respective refining zone.

6. The refiner segment according to claim 5, wherein each respective feeding angle is between 5° and 45°.

7. The refiner segment according to claim 5, wherein each respective angle is between 5° and 45°.

8. The refiner segment according to claim 1, wherein a radially inner end of every other bar is connected to a dam.

9. The refiner segment according to claim 1, wherein at least some of the dams have a smaller height than the bars.

10. The refiner segment according to claim 1, wherein the plurality of intermediate grooves and the plurality of openings comprise a free passage through all of the plurality of refining zones for steam to flow towards the radially inner edge of the refiner segment.

11. A refiner element for refining fibrous material, comprising at least one refiner segment according to claim 1.

12. A refiner for refining fibrous material, comprising at least one refiner segment according to claim 1.

* * * * *